United States Patent [19]

Restarick

[11] 4,258,79

[45] Mar. 31, 198

[54] HYDRAULIC TUBING TENSIONER

[75] Inventor: Henry L. Restarick, Metairie, La.

[73] Assignee: Otis Engineering Corporation, Dallas, Tex.

[21] Appl. No.: 20,811

[22] Filed: Mar. 15, 1979

[51] Int. Cl.[3] ..... E21B 17/00

[52] U.S. Cl. ..... 166/315; 166/98; 166/242; 285/18; 285/302; 285/DIG. 21

[58] Field of Search ..... 285/18, 302; 166/242, 166/120, 98, 315, 212

[56] References Cited

U.S. PATENT DOCUMENTS

| | | | |
|---|---|---|---|
| 2,377,249 | 3/1945 | Lawrence | 166/98 |
| 2,878,877 | 3/1959 | Baker | 166/120 X |
| 2,901,044 | 8/1959 | Arnold | 166/212 X |
| 2,984,302 | 3/1961 | Church | 166/ |
| 3,023,811 | 3/1962 | Green | 166/98 |

*Primary Examiner*—William F. Pate, III

*Attorney, Agent, or Firm*—Thomas R. Felger

[57] ABSTRACT

An apparatus or tool for applying tension to a tubir string. The tool comprises a housing and a sleeve with the housing. One end of the housing is attached to tl tubing string and the opposite end of the sleeve is a tached to the tubing string. Hydraulic fluid pressu acts upon a piston carried by the sleeve to contract tl sleeve relative to the housing and apply tension to tl tubing string. The hydraulic tubing tensioner can t used to apply tension to tubing between two packers c to apply tension to a tubing string extending from downhole packer to the well surface.

15 Claims, 17 Drawing Figures

HYDRAULIC TUBING TENSIONER

BACKGROUND OF THE INVENTION

1. Field of the Invention

The present invention is a tool for applying tension to a tubing string within a well bore. The tool or apparatus allows tension to be applied to the tubing string without the requirement for equipment to raise and lower the tubing string at the well surface. Also, methods are disclosed for using the tool to complete wells.

2. Description of the Prior Art

Most producing oil and gas wells have a well bore defined by a casing string and tubing disposed within the casing. A packer generally is used to seal between the tubing and casing and to direct formation fluid flow through the tubing to the well surface.

The tubing string is frequently placed in tension between the packer and the surface to minimize tubing buckling from pressure and temperature changes, to minimize contact between the tubing and a pump rod, and to allow unrestricted wireline operations through the tubing bore. Also, tension may be applied to the tubing to evenly distribute the weight of the tubing string between a tubing hanger at the well surface and the downhole packer.

Tension is commonly placed on the tubing string by engaging the lower end of the tubing with a packer previously installed downhole in the casing, raising the tubing by conventional drawworks until the desired tension is shown on a weight indicator and then setting slips to secure the tubing at the well surface. The sequence of spacing out the tubing at the well surface usually requires the use of one or more short sections of tubing called pup joints. Also, the surface blowout preventers must be removed for considerable lengths of time while installing the pup joints and setting the slips at the well surface. The present invention reduces the amount of tubing manipulation previously required at the well surface to place a tubing string in tension. The present invention can be used in various types of wells including oil and gas, steam and water injection, and geothermal wells.

U.S. Pat. No. 2,836,250 to C. C. Brown discloses a sleeve slidably disposed within a housing used to set a packer. Hydraulic fluid pressure acts on a piston carried by the sleeve to extend the sleeve relative to the housing forcing slips to engage the inner wall of the casing. U.S. Pat. No. 2,836,250 does not disclose nor teach using a sleeve and housing to apply tension to a tubing string.

SUMMARY OF THE INVENTION

The present invention discloses a tool or apparatus for applying tension to a tubing string, comprising: a housing with a longitudinal bore extending therethrough; means for attaching one end of the housing to a tubing string; a sleeve, slidably disposed within the longitudinal bore, having a longitudinal passageway therethrough and one end of the sleeve extending from said longitudinal bore, means for attaching the one end of the sleeve to a tubing string, means for sealing between the longitudinal bore and the sleeve to form a fluid chamber, a piston means carried on the exterior of the sleeve dividing the fluid chamber into two variable volume zones, the housing having a first port communicating the exterior of the housing with one of the variable volume zones, the sleeve having a second port communicating the longitudinal passageway with the other variable volume zone, and means for allowing sleeve to move in one direction within the longitudi bore and preventing movement of the sleeve in other direction within the longitudinal bore.

One object of the present invention is to provid tool for applying tension to a tubing string dispo with in a well.

Another object of the present invention is to prov a tubing tensioning tool which can apply tension t tubing string by increasing the hydraulic fluid press within the tubing string.

Still another object of the present invention is provide a hydraulic tubing tensioner which can ap tension to a tubing string communicating between t packers within a well.

A further object of the present invention is to discl a method of applying tension to a tubing string withi well without having to use conventional draw work the well surface.

Still a further object of present invention is to discl a method for working over a well to install a dual draulic packer above a permanently installed pac and to place the tubing string between both packer tension.

These and other objects and advantages of the pr ent invention will become apparent from the follow drawings, detailed description, and claims.

DESCRIPTION OF THE PREFERRED EMBODIMENT

Figure 1A:
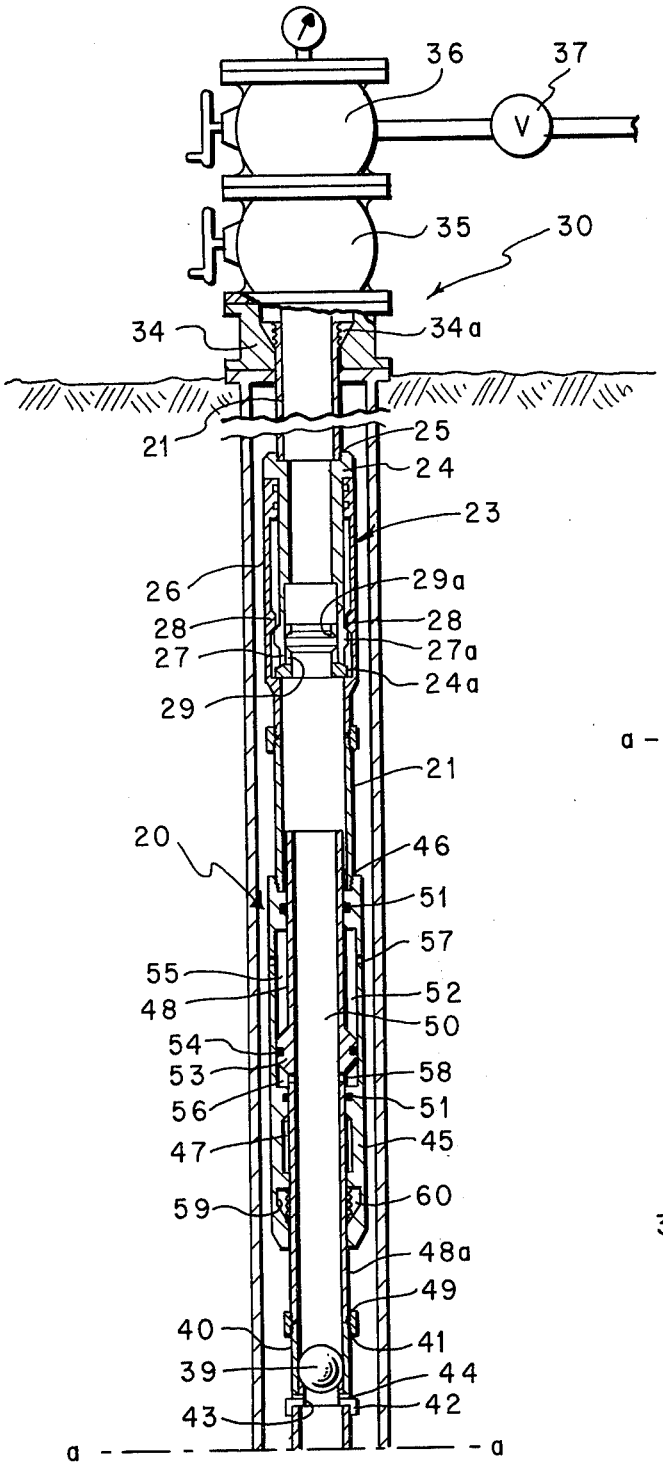
FIGS. 1A and 1B (referred to as FIG. 1) are dra ings, partially in section and elevation, showing a ty cal well installation using the present invention to ap tension to tubing between a surface tubing hanger an downhole packer.

Referring to the drawings and particularly to FIG the hydraulic tubing tensioner 20 of the present inv tion is shown as part of tubing string 21. The well co pletion or installation shown in FIG. 1 comprises w head 30 supported on casing string 31 and product packer 32 secured within casing 31 intermediate ends thereof.

Figure 1B:
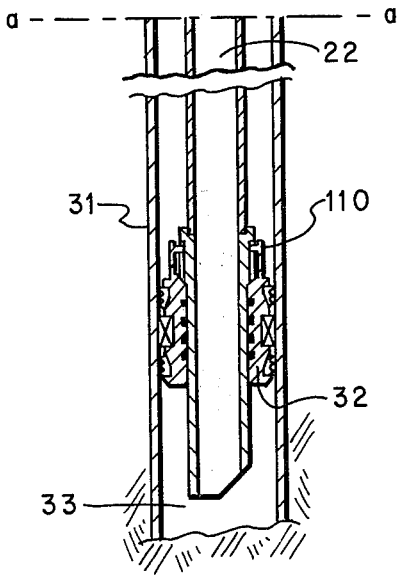

Packer 32 is used to provide fluid tight seals betw casing 31 and the lower portion of tubing 21. Packer directs formation fluids entering casing bore 33 bel packer 32 to flow to the well surface through bore 2 tubing 21. Various types of conventional packers ble for use with the present invention. One such er is disclosed in U.S. Pat. No. 3,398,795 to T. L. ton. This type of packer is particularly desirable for with tubing tensioner 20 because tubing string 21 be engaged and disengaged from the packer in U.S. No. 3,398,795 as desired. Also, tension is used to rely anchor the packer within well casing. U.S. Pat. 3,398,795 is incorporated by reference for all oses within this written description.

typical tubing string may contain various well tools as landing nipples, subsurface safety valves, and gas lift valves. These well tools could be added to ng string 21 as desired. In addition to hydraulic ng tensioner 20, tubing string 21 has a wireline re- ble travel joint 23 and an expendable catcher subas- bly 40. The operation and purpose of these two will be explained later.

ellhead 30 is supported on casing 31 at the well ace. Surface tubing hanger 34 including slips 34*a* s a part of wellhead 30 and engages the upper ion of tubing 21. As shown in FIG. 1, tubing 21 is ally supported by packer 32 and partially by sur- tubing hanger 34. Wellhead 30 includes master e 35 and swab valve 36 which control fluid commu- ion with tubing 21. Wing valve 37 is provided to rol flow from pressure source 38 to wellhead 30.

ydraulic tubing tensioner 20 comprises housing 45 threads 46 at one end providing a means for attach- ousing 45 to tubing string 21. A longitudinal bore xtends through housing 45 with openings at either thereof. Sleeve 48 is slidably disposed within bore ith one portion 48*a* extending from bore 47. The portion 48*a* has threads 49 providing means for hing one end of sleeve 48 to tubing string 21.

eeve 48 is generally cylindrical with its longitudinal concentric with the longitudinal axis of bore 47. ve 48 also contains a longitudinal passageway 50 ding therethrough. Hydraulic tubing tensioner 20 ade up as a portion of tubing string 21 by attaching end of sleeve 48 having threads 49 to tubing 21 and pposite end of housing 45 to tubing 21 by threads luid can communicate between the tubing attached e and below tensioner 20 via longitudinal passage- 50 in sleeve 48.

al means 51 are carried on the inside diameter of ing 45 within bore 47. The concentric arrangement eeve 48 within bore 47 forms an annulus between utside diameter of sleeve 48 and the inside diameter ousing 45. Seal means 51 are in a fixed position ive to housing 45 and engage the outside diameter eeve 48 to form a fluid or piston chamber 52. Piston s 53 is carried on the exterior of sleeve 48 within chamber 52. Piston seals 54, a part of piston means orm a fluid tight barrier with the inside diameter of ing 45. Piston means 53 with piston seals 54 at- ed is moveable with respect to housing 45 and di- s chamber 52 into two variable volume zones 55 56.

rst lateral ports 57 penetrate housing 45 to allow communication between the exterior of housing 45 variable volume zone 55. Second lateral ports 58 trate sleeve 48 to allow communication of fluid een longitudinal passageway 50 and variable vol- zone 56.

ousing 45 contains a recess 59 spaced longitudinally chamber 52. Slips 60 are secured within recess 59 h is part of longitudinal bore 47 and have teeth h are engageable with the exterior of sleeve 48. Slips 60 provide a means for allowing sleeve 48 to move in one direction within bore 47 and preventing movement of sleeve 48 in the other direction within bore 47. Therefore, when fluid pressure within longitudinal passageway 50 is higher than fluid pressure on the exterior of housing 45, the higher fluid pressure will be transmitted through ports 58 into variable volume zone 56 and applied to piston means 53. The pressure differential across piston means 53 will cause sleeve 48 to slide or contract longitudinally with respect to housing 45. The high pressure in variable volume zone 56 will move piston means 53 to displace any fluid within variable volume zone 55 to the exterior of housing 45 through ports 57. The teeth on slips 60 are aligned to allow movement of sleeve 48 in this one direction. if the fluid pressure within variable volume zone 55 was higher than fluid pressure within variable volume zone 56, sleeve 48 would attempt to move in the other direction. However, slips 60 would engage the exterior of sleeve 48 and prevent movement relative to housing 45. The use of internal slips 60 is disclosed in U.S. Pat. No. 3,398,795 to T. L. Elliston.

Various conventional well tools are available to temporarily seal or plug bore 22 of tubing 21 so that fluid pressure within longitudinal passageway 50 can be increased to any desired value. FIG. 1 shows one well tool, catcher subassembly 40, which can provide this function.

Catcher sub 40 is made up as part of tubing string 21 by threads 41 and 42. An expendable valve seat 43 is secured to the inside diameter of catcher sub 40 by shear pins 44. A suitable check valve member, such as ball 39, can be pumped through bore 22 of tubing 21 including longitudinal passageway 50 until ball 39 contacts valve seat 43. Ball 39 and seat 43 form a fluid tight barrier within tubing 21 so that fluid pressure within longitudinal passageway 50 can be increased. When the fluid pressure acting on ball 39 exceeds a preselected value, pin 44 will shear releasing seat 43 from the inside diameter of catcher sub 40. Ball 39 and seat 43 will then be expended out the lower end of tubing 21. The value at which pin 44 shears can be preselected such that the desired pressure buildup will occur within variable volume zone 56 to apply a preselected amount of force to sleeve 48 contracting sleeve 48 relative to housing 45. One way to prevent tensioner 20 from over stressing tubing 21 is by proper selection of shear pin 44.

Figure 8A:
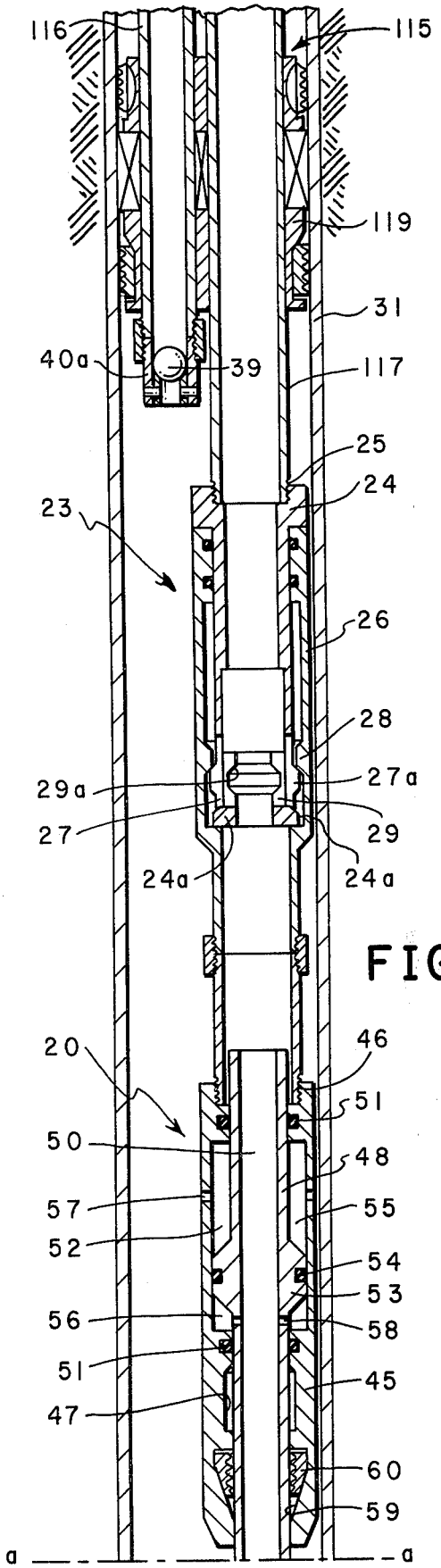
FIGS. 8A and 8B are schematic drawings, partially section, showing the present invention in a typi workover installation to apply tension to a tubing str between two packers downhole.

During some well maintenance evolutions it may be desirable to release the tension applied to tubing 21 by tensioner 20. One such evolution might be to release tubing 21 from packer 32. Wireline releasable travel joint 23 is made up as part of tubing string 21. Travel joint 23 is shown in FIGS. 1 and 8A comprising an inner mandrel 24 which is attached to tubing string 21 at threads 25. An outer mandrel 26 is slidably disposed surrounding most of inner mandrel 24. Seals are provided to prevent fluid flow between the outside diameter of mandrel 24 and the inside diameter of mandrel 26. Inner mandrel 24 includes collet fingers 27 with collet heads 27*a* that can flex inwardly. Outer mandrel 26 has a rib 28 formed on its inside diameter which contacts collet heads 27*a*. Collet heads 27*a* engage rib 28 to hold travel joint 23 in its collapsed position. Collet cylinder 29 is slidably disposed within the bore of inner mandrel 24 and normally prevents collet fingers 27 from flexing inwardly. Collet cylinder 29 contains an internal profile 29*a* which can be engaged by a wireline tool (not shown) to shift cylinder 29 upward allowing collet fingers 27 to flex inward and release collet heads 27*a* from rib 28. Inner mandrel 24 and outer mandrel 26 can then telescope to their fully extended position. An enlarged portion 24*a* on inner mandrel 24 prevents the two mandrels from fully disengaging. A wireline releasable travel joint satisfactory for use with the present invention is shown in Otis Engineering Corporation Packers Catalog (OEC 5120A) page 48 published during 1978.

FIGS. 2A–2D and 3A–3E show a hydraulic tubing tensioner 70 in more detail. FIGS. 2A–2D show tensioner 70 with sleeve 71 extended relative to housing 72. FIGS. 3A–3E show tensioner 70 with sleeve 71 contracted relative to housing 72. Sleeve 71 and housing 72 are assembled from subassemblies for ease of manufacture. Subassemblies are designated with a letter following the number.

Housing 72 has seven subassemblies which are generally cylindrical and are attached to each other by threaded connections. Each subassembly has a longitudinal bore which comprises bore 47 within housing 72. Tubing connector subassembly 72*a* has threads 74 formed at one end to provide a means for attaching housing 72 to a tubing string. Adapter subassembly 72*b* joins connector sub 72*a* to fluid chamber subassembly 72*c*. Adapter subassembly 72*b* also carries seal mean 75*a* on its inside diameter to form a fluid tight seal with the exterior of sleeve 71. Adapter subassembly 72*b* includes shoulder 76 which projects into fluid chamber 52 to provide a mechanical stop limiting the travel of sleeve 71 in one direction relative to housing 72.

Fluid chamber subassembly 72*c* partially defines fluid or piston chamber 52. First lateral ports 57 penetrate subassembly 72*c* and communicate fluid between the exterior of housing 72 and variable volume zone 55. The inside diameter 77 of subassembly 72*c* is preferably a honed surface to provide a better fluid tight seal with piston means 80 carried by sleeve 71. Adapter subassembly 72*d* joins fluid chamber subassembly 72*c* to transition subassembly 72*e* and collar subassembly 72*f*.

Adapter subassembly 72*d* carries seal means 75*b* on its inside diameter to form a fluid tight seal with the exterior of sleeve 71. Fluid chamber or piston chamber 52 is defined by seal means 75*a* and 75*b*, the exterior of sleeve 71 and the inside diameter 77 of housing subassembly 72*c*. O-ring seals 78 are carried on the exterior of adapter subassembly 72*d* to form a fluid tight barrier with honed surface 77. Variable volume zone 56 is defined in part by piston means 80, seal means 75*b*, o-ring seals 78, inside diameter 77 and the exterior of sleeve 71.

Figure 2A:
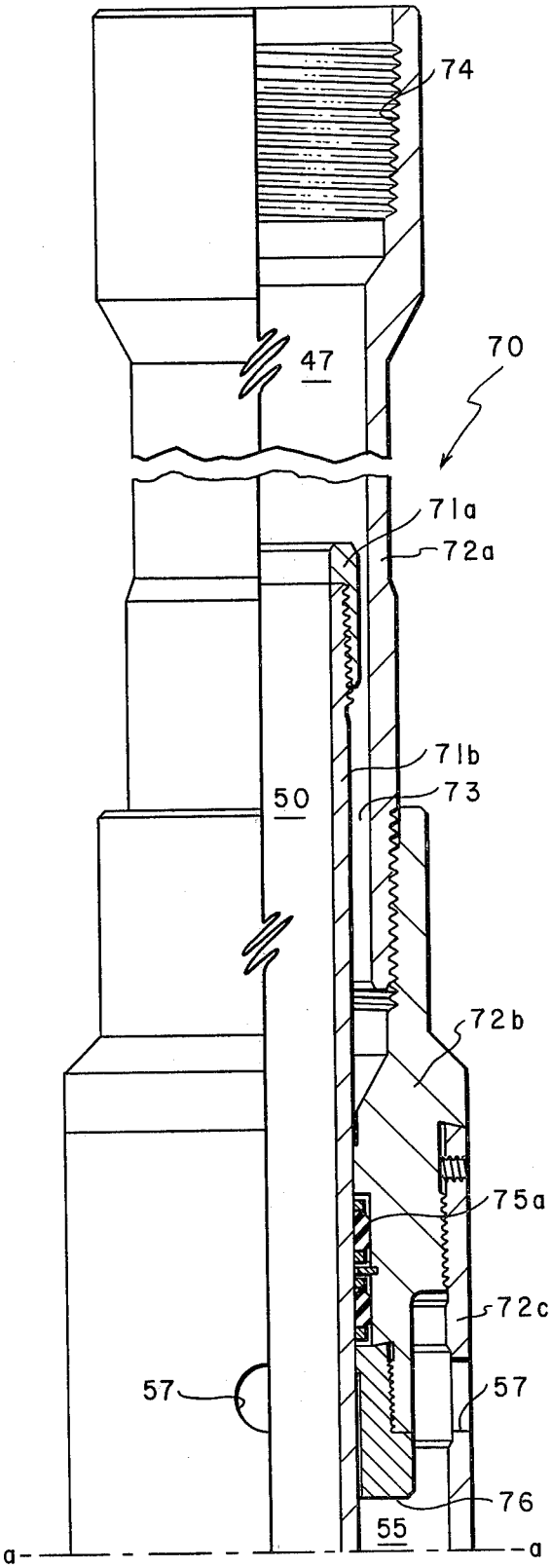
FIGS. 2A, 2B, 2C and 2D are drawings, partially section, showing the hydraulic tubing tensioner of present invention in its fully extended position.
Figure 2B:
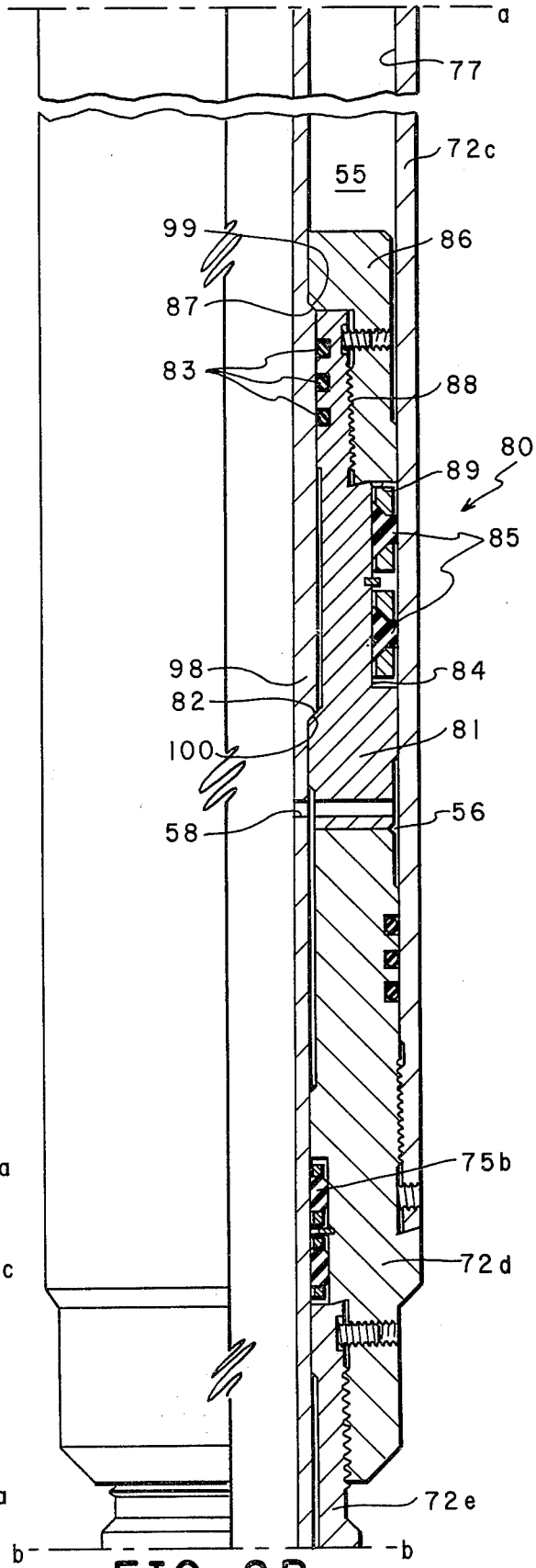
Figure 2C:
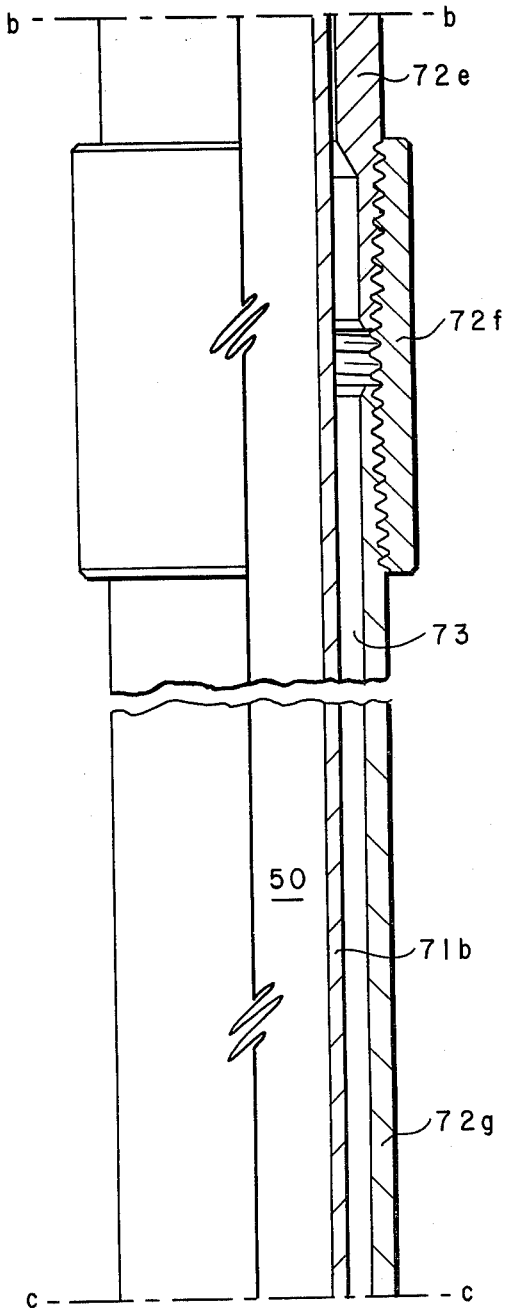
Figure 2D:
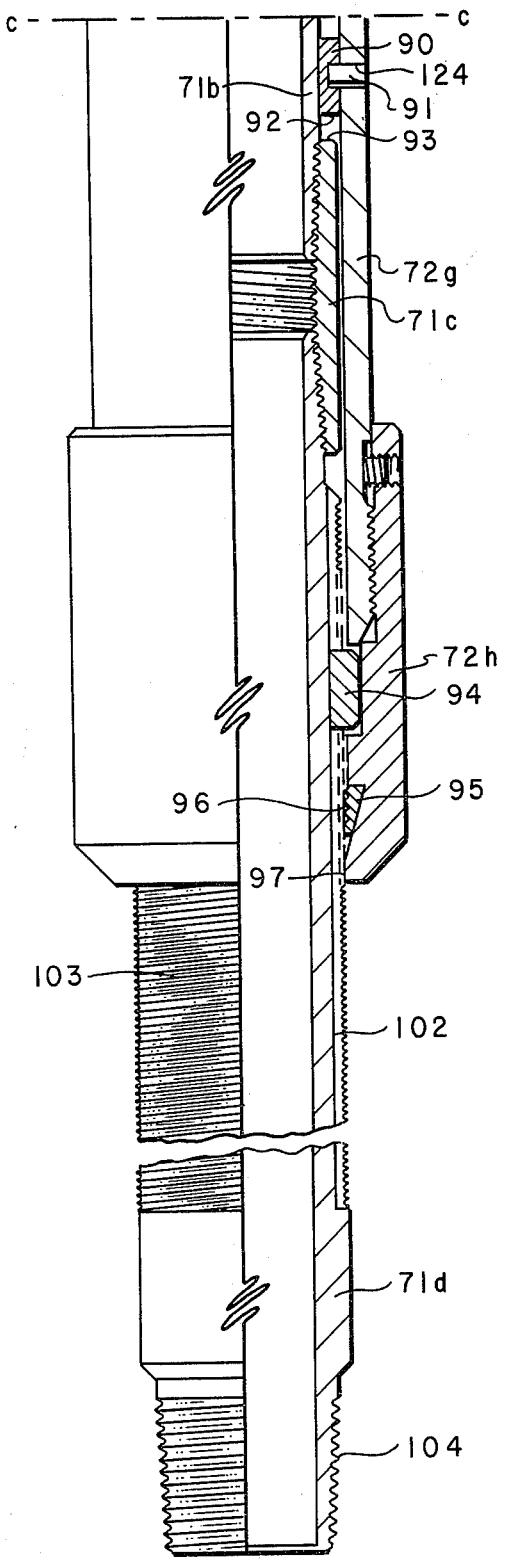
Figure 3A:
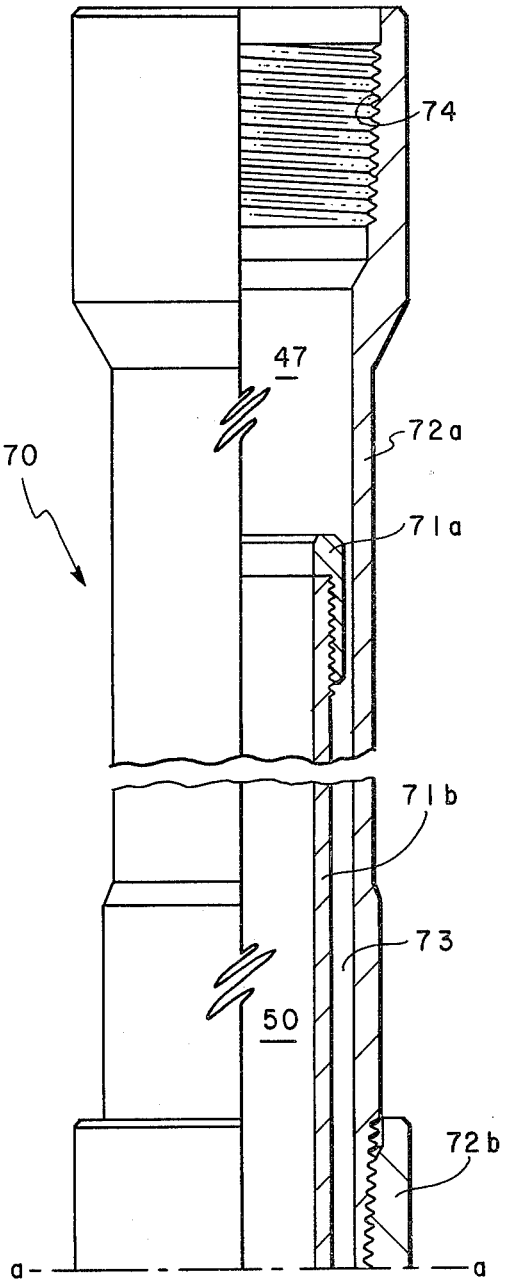
FIGS. 3A, 3B, 3C, 3D and 3E are drawings, partia in section, showing the hydraulic tubing tensioner of present invention in its partially retracted position.
Figure 3B:
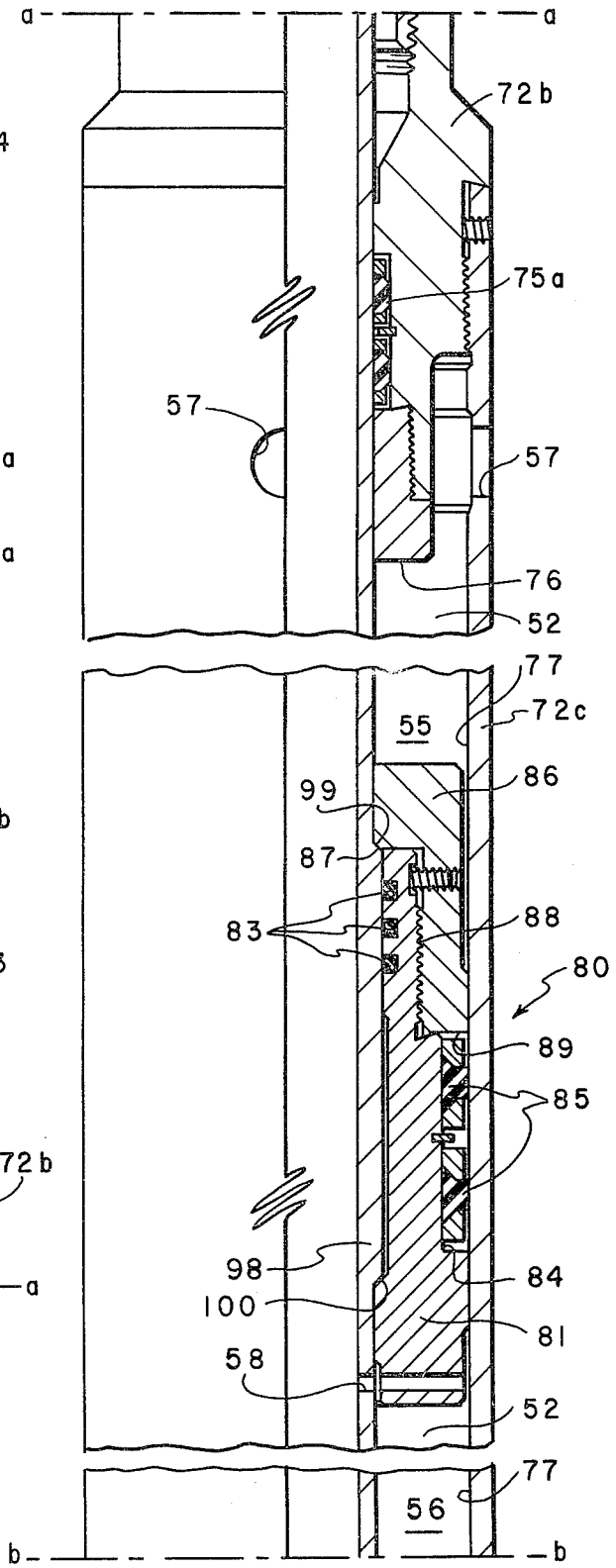
Figure 3C:
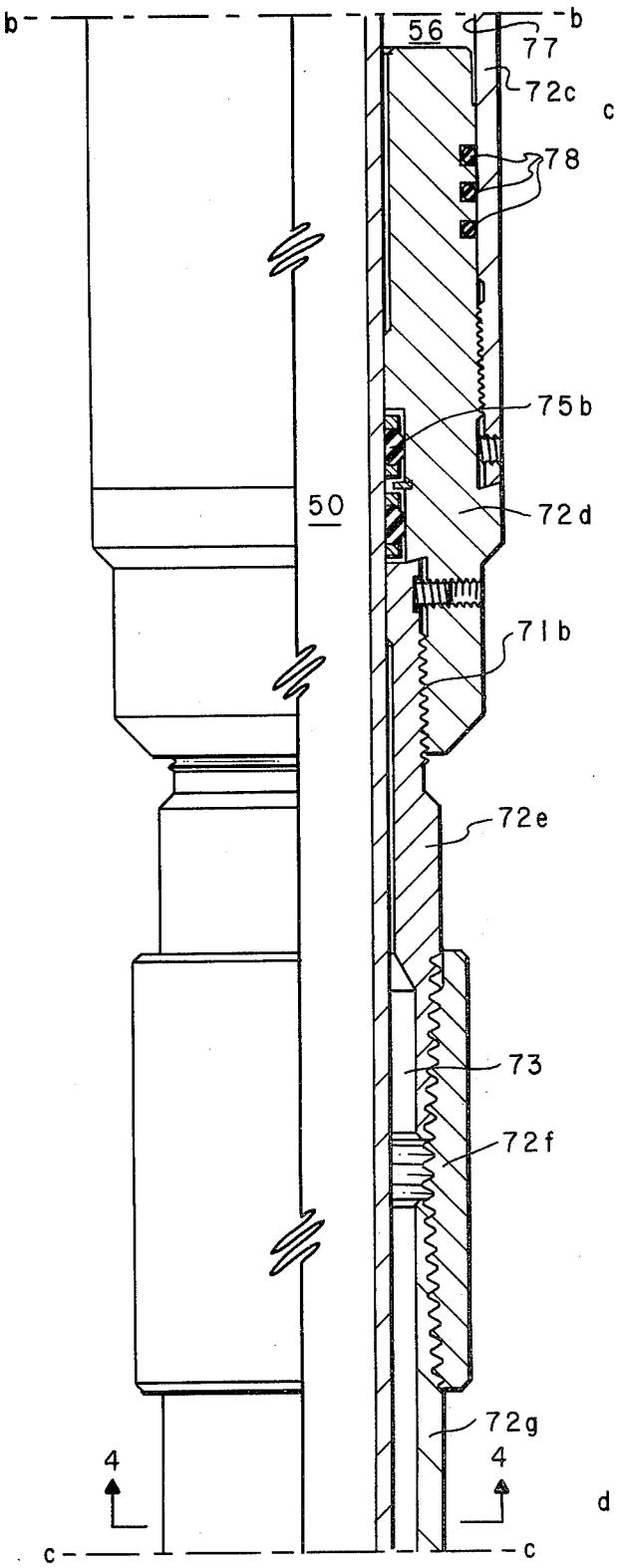
Figure 3D:
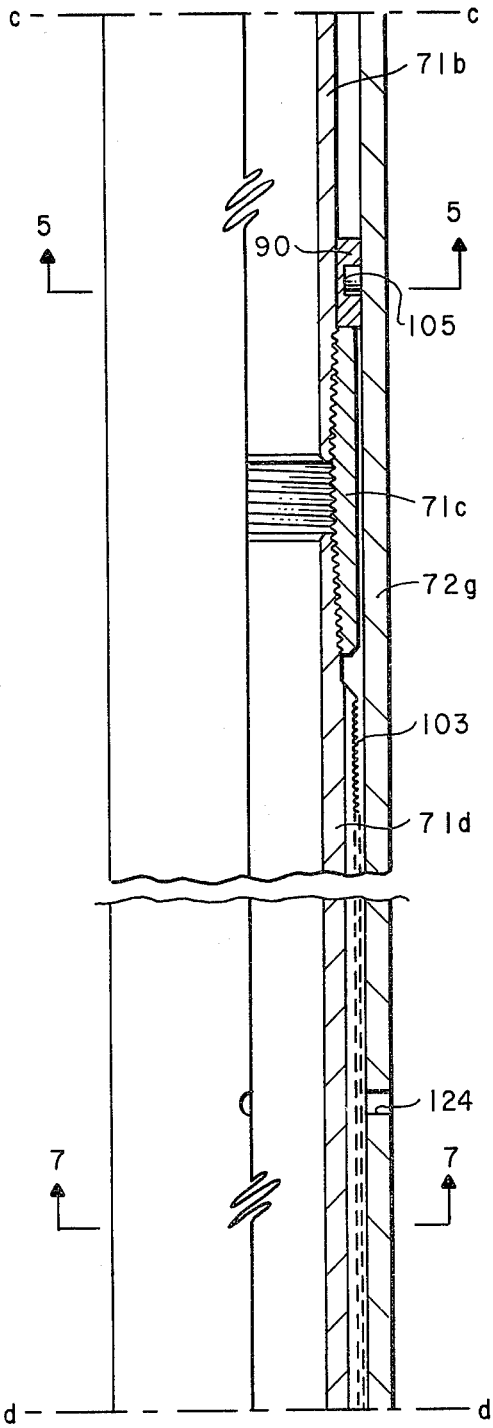
Figure 5:
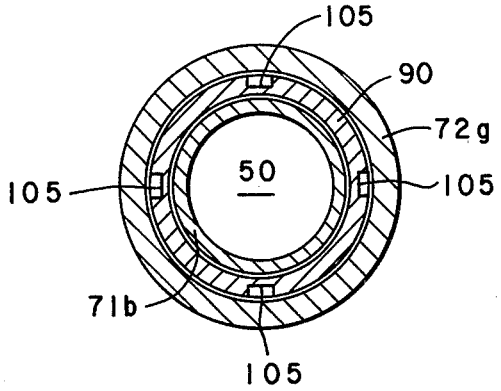
FIG. 5 is a sectional view taken on line 5—5 of F 3D.

Housing subassembly 72*g* connects collar subassembly 72*f* with alignment and slip subassembly 72*h*. Retainer means 90 is secured to the inside diameter of housing subassembly 72*g* by shear pin 91. Opening 124, penetrating the wall of housing subassembly 72*g*, receives pin 91. As best shown in FIG. 2D retainer means 90 has a shoulder 92 which can engage a matching shoulder 93 on sleeve 71 to prevent movement of sleeve 71 in the one direction relative to housing 72 until enough force has been applied to sleeve 71 to shear pin 91. FIGS. 3D and 5 show retainer means 90 released from housing subassembly 72*g*.

As best shown in FIG. 5, retainer means 90 comprises a cylindrical ring slidably disposed between sleeve subassembly 71*b* and housing subassembly 72*g*. Lateral bore holes 105 are provided to receive shear pins 91.

Alignment and slip subassembly 72*h* carries keys 94 and slips 95 within bore 47. Slips 95 have teeth 96 which allow movement of sleeve 71 in the one direction rel tive to housing 72 and prevents movement of sleeve in the other direction. Sleeve 71 extends from housi 72 through opening 97 in subassembly 72*h*.

Sleeve 71 comprises four subassemblies with ea subassembly joined by a threaded connection. Flo adapter subassembly 71*a* is an end fitting for main sub sembly 71*b*. Flow adapter 71*a* minimizes flow turb lence and erosion while flowing formation flui through longitudinal passageway 50. The exterior main subassembly 71*b* is preferably a finished surface provide a fluid tight barrier with seal means 75*a* a 75*b*. Piston means 80 is carried on an enlarged outsi diameter portion 98 formed on the exterior of subasse bly 71*b*. Enlarged portion 98 has two shoulders 99 a 100 formed thereon to secure piston means 80 to slee 71. Piston means 80 comprises piston ring 81 which is generally cylindrical ring surrounding sleeve 71. T inside diameter of piston ring 81 has a shoulder which matches shoulder 100 of enlarged portion 9 Seal means 83 are also carried on the inside diameter piston ring 81 to prevent fluid flow between the exteri of sleeve 71 and the inside diameter of piston ring 8 Recess 84 is formed on the outside diameter of pist ring 81. Piston seals 85 are carried within the recess and form a moveable fluid tight barrier with the insi diameter 77 of housing subassembly 72C. Piston cap is a cylindrical ring which can be engaged with pist ring 81 at threads 88. Shoulder 87 is formed on t inside diameter of piston cap 86 and mates with sho der 99 of sleeve 71. Thus, piston means 80 is secured sleeve 71 by engaging enlarged portion 98 betwe shoulders 82 and 87 while connecting piston ring with piston cap 86 at threads 88. Shoulder 89 is form on the outside diameter of piston cap 86 to secure pist seals 85 within recess 84. Piston means 80 divides t piston chamber or fluid chamber 52 into two variab volume zones 55 and 56.

Second lateral ports 58 through main subassemb 71*b* communicate fluid between longitudinal passag way 50 and variable volume zone 56. Main subassemb 71*b* is attached to slip engaging subassembly 71*d* collar subassembly 71*c*. Collar subassembly 71*c* pr vides shoulder 93 to engage retainer means 90 as pre ously described.

Figure 6:
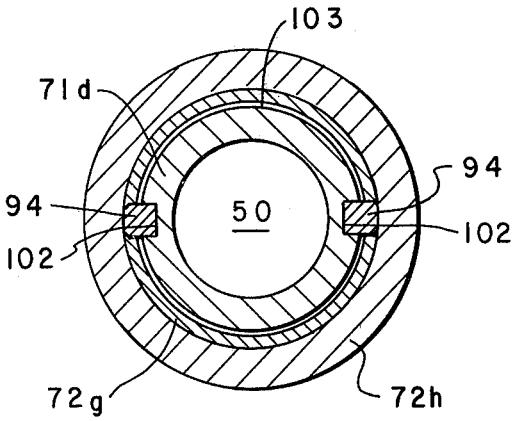
FIG. 6 is a sectional view taken on line 6—6 of F 3E.
Figure 7:
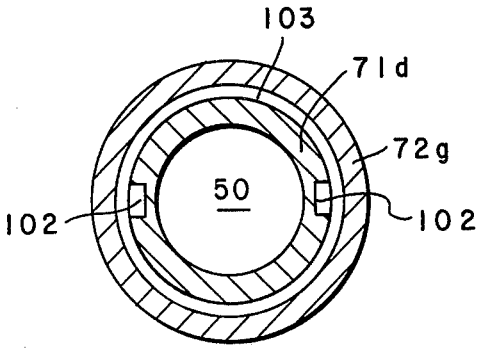
FIG. 7 is a sectional view taken on line 7—7 of F 3D.

Subassembly 71*d* has keyways 102 formed in its o side diameter. As best shown in FIG. 6, keys 94 carri by housing subassembly 72*h* are engaged with keywa 102 of sleeve subassembly 71*d* to prevent rotation sleeve 71 relative to housing 72. As previously note housing subassembly 72*g* is engaged by threads wi housing subassembly 72*h*. For ease of manufactu housing subassembly 72*g* extends into the bore of sub sembly 72*h* as shown in FIG. 6. Two short, opposi longitudinal slots are cut in the lower portion of sub sembly 72*g* which extends into subassembly 72*h*. Ke 94 are fitted into these slots as shown in FIG. 6. The fore, when housing subassemblies 72*g* and 72*h* are e gaged, keys 94 are prevented from rotating with resp to housing 72. Keys 94 and keyways 102 allow torque be transmitted from the tubing attached above tension 70 to the tubing attached below tensioner 70.

Figure 3E:
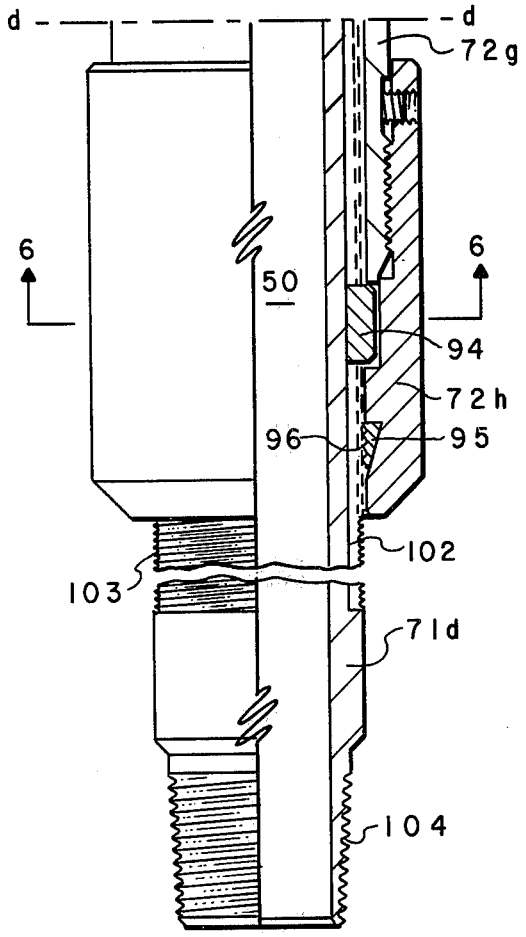
Figure 4:
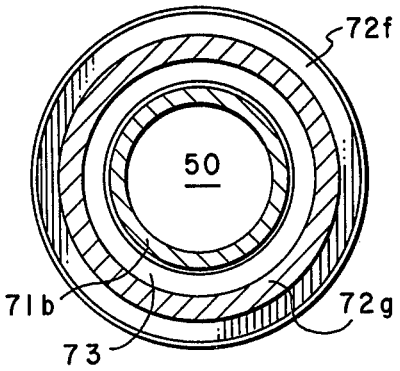
FIG. 4 is a sectional view taken on line 4—4 of F 3C.

Preferably, the outer surface 103 of sleeve subasse bly 71*d* contains fine threads as best shown in FIGS. 2 and 3E. The fine threads allow slips 95 to secur engage outer surface 103 preventing movement sleeve 71 in the other direction relative to housing Threads 104 are formed on one end of sleeve subasse 71*d* to provide a means for attaching sleeve 71 to a ing string.

OPERATING SEQUENCE

Iydraulic tubing tensioner 70 is a tool or apparatus applying tension to a tubing string. Tensioner 70 is le up as a portion of a tubing string by attaching the 'er section of the tubing to sleeve 71 at threads 104 the upper section of the tubing to housing 72 at eads 74. The tubing is initially installed within a well, ing a casing string, in its fully extended position as wn in FIGS. 2A–2D. The tubing is secured within well by suitable means such as packer 32 and tubing ger 34 as shown in FIG. 1. The pressure of fluid hin longitudinal passageway 50 can be increased r sealing the tubing bore with a means such as ball 39 catcher subassembly 40.

'he pressure of fluid within longitudinal passageway s transmitted to variable volume zone 56 by second ral ports 58. When fluid pressure in variable volume e 56 exceeds the pressure of fluid (if any) in zone 55, on means 80 will move expanding variable volume e 56 and displacing fluid in zone 55 to the exterior of sing 72 through first lateral ports 57. This move- it of piston means 80 causes sleeve 71 to contract or ve longitudinally with respect to housing 72 in the direction. With the ends of the tubing string secured hown in FIG. 1, contraction of tensioner 70 causes ion to be applied to the tubing string. Slips 95 allow ve 71 to move in the one direction relative to hous- 72. Slips 95 firmly engage the rough surface 103 to vent movement of sleeve 71 in the other direction en pressure is released from variable volume zone 56.

'he amount of tension applied to a tubing string can imited by controlling the pressure within passage- / 50. The maximum amount of tension is determined he distance or stroke between piston means 80 and shoulder 76 when tensioner 70 is fully extended. By cting the proper stroke length versus tubing length, possible to ensure that the tubing will not be over ssed by tensioner 70.

During some well conditions such as high formation sure or high hydrogen sulfide concentration in the nation fluids, it is desirable to minimize the number perations and the length of time requiring removal he blowout preventers (not shown) while complet- the well.

or an oil gas well such as FIG. 1, tubing 21 is in- ed within casing 31 through blowout preventers. use of blowout preventers with various combina- s of rams is well known. One method of applying ion to a tubing string and spacing out the tubing sists of securing the lower end of the tubing string to casing by means such as packer 32. Conventional w works (not shown) are used to raise the tubing l the weight indicator shows that the desired unt of tension has been placed on the tubing string. blowout preventers are removed and the tubing ked at the location of the surface tubing hanger. The k is usually intermediate the ends of a section of ng. Therefore, one or more pup joints are required xtend from the last full joint or section of tubing to surface tubing hanger.

fter marking the tubing, the tubing is then raised to w removal of the section of tubing having the mark. joints equivalent to the length from the lower end he removed section of tubing to the mark are in- ed and standard lengths of tubing attached to the top of the pup joints. The tubing string is then lowered into the well and secured to the casing at packer 32. The tubing string is raised until the desired tension is shown on the weight indicator (not shown). If the mark was properly made and the pup joints properly measured, the top of the upper pup joint should be level with the surface tubing hanger 34. The surface tubing hanger slips 34*a* are set to engage the tubing string. The tubing attached above the pup joints is removed and the well- head installed to establish positive pressure control of th9e well. With the above procedure, the blowout pre- venters are removed while spacing out. Tensioner 20 or tensioner 70 would reduce the time between removal of the blowout preventers and connection of wellhead 30. Tensioner 20 and/or tensioner 70 significantly mini- mizes the tubing handling requirements.

Packer 32 is installed intermediate the ends of casing 31 at a preselected distance from the well surface. Tub- ing string 21 including expendable catcher subassembly 40, hydraulic tubing tensioner 20 and wireline releasable travel joint 23 is lowered into bore 33 of casing 31 through blowout preventers (not shown). The lower portion of tubing 21 is secured to packer 32 by J-latch 110. The blowout preventers are removed and the tub- ing string raised or lowered until the top of a full joint of pipe or section of tubing is at the surface tubing hanger. For long lengths of tubing strings, movement of one section of tubing is possible without over stressing the tubing. Slips 34*a* of the surface tubing hanger are then secured to the top end of the full section of tubing and wellhead 30 including master valve 35 and swab valve 36 installed. Wellhead 30 provides for positive well fluid pressure control. Wing valve 37 can be opened to admit fluid pressure to bore 22 of tubing 21. If ball 39 is engaged with valve seat 43, pressure in longitudinal passageway 50 can be increased to a prese- lected value. As previously described, fluid pressure in passageway 50 causes tensioner 20 to contract applying tension to tubing 21. At a preselected pressure, pin 44 will shear releasing seat 43 and ball 39 limiting the amount of tension applied to tubing 21.

Figure 8B:
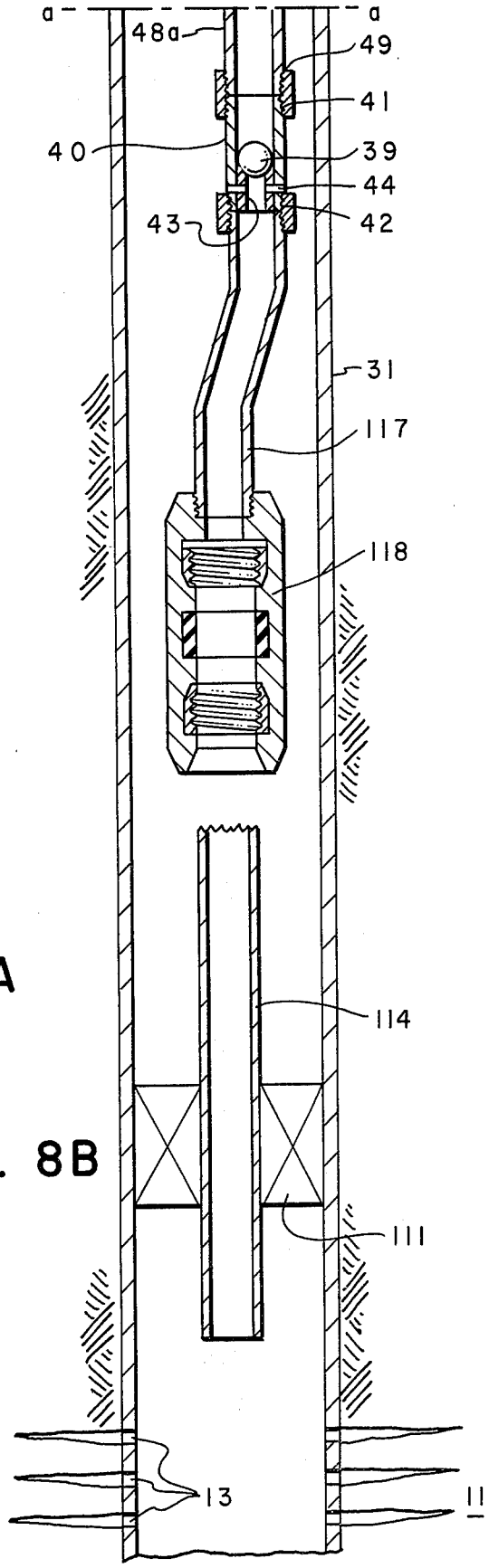

Hydraulic tubing tensioner 20 can also be used to apply tension to tubing under conditions when normal methods are not available. FIGS. 8A and 8B illustrate such a use for tensioner 20.

Packer 111 is installed within casing 31 above pro- ducing formation 112 and perforations 113. Tubing string 114 is secured within packer 111 and extended only a limited distance above packer 111. Tubing 114 may have failed at this point from corrosion and wear or may have been purposely cut off to facilitate recom- pletion of the well for dual production tubing strings.

A dual completion tubing string is shown being low- ered into the well comprising dual production packer 115 with a short tubing string 116 and a long tubing string 117. Short tubing string 116 will allow formation fluids entering the bore of casing 31 between packer 111 and dual packer 115 to flow to the well surface. Long tubing string 117 comprises wireline releasable travel- ing joint 23, tensioner 20, expendable catcher subassem- bly 40 and a packoff overshot or overshot connector 118. U.S. Pat. No. 3,865,408 discloses an overshot con- nector satisfactory for use with the present invention. U.S. Pat. No. 3,865,408 is adopted by reference for all purposes.

The dual tubing string is lowered into the well until overshot 118 engages tubing 114 and forms a fluid tight seal with the exterior of tubing 114. Dual production packer 115 can then be secured to casing 31 by applying hydraulic fluid pressure to short tubing string 116 from the well surface. A modified catcher subassembly 40a is provided to allow pressure buildup to a preselected value within short tubing string 116. After dual packer 115 has been set, fluid pressure can be applied to tubing string 117 from the well surface to contract hydraulic tubing tensioner 20. The section of tubing joining packer 111 and dual packer 115 can thus be placed in tension.

Alternatively, dual packer 115 could be initially anchored to casing 31 by the contraction of tensioner 20. As shown in FIG. 8A, tension on tubing 117 below packer 115 can be transmitted to cone 119 forcing slips 120 on packer 115 radially outward into contact with casing 31. Dual hydraulic production packers which are set by either the long string or short string are generally available. In this alternative method, packer 115 is set at the same time as tensioner 20 is being contracted.

The previously described hydraulic tubing tensioner can be readily adapted for use in various wells. The previous description is illustrative of only two embodiments of the presents invention and methods of using the invention. Changes and modifications will be readily apparent to those skilled in the art and may be made without departing from the scope of the invention which is defined in the claims.

What is claimed is:

1. A tool for applying tension to a tubing string, comprising:

a. a housing with a longitudinal bore extending therethrough;

b. means for attaching one end of the housing to a tubing string;

c. a sleeve, slidably disposed within the longitudinal bore, having a longitudinal passageway therethrough and one end of the sleeve extending from said longitudinal bore;

d. means for attaching the one end of the sleeve to a tubing string;

e. means for sealing between the longitudinal bore and the sleeve to form a fluid chamber;

f. a piston means, carried on the exterior of the sleeve, dividing the fluid chamber into two variable volume zones;

g. the housing having a first port communicating the exterior of the housing with one of the variable volume zones;

h. the sleeve having a second port communicating the longitudinal passageway with the other variable volume zone; and i. means for allowing the sleeve to move in one direction within the longitudinal bore and preventing movement of the sleeve in the other direction within the longitudinal bore.

2. A tool for applying tension to a tubing string as defined in claim 1, further comprising:

a. a longitudinal keyway formed on the exterior of the sleeve;

b. key means carried by the housing within the longitudinal bore; and c. the key means positioned within the keyway to prevent rotation of the sleeve with respect to the housing.

3. A tool for applying tension to a tubing string as defined in claim 1, further comprising:

a. a retainer means disposed within the longitudinal bore between the sleeve and the housing;

b. means for releasably securing the retainer mean the housing; and c. a shoulder formed on the exterior of the sle adjacent the retainer means whereby the sleev held in an extended position relative to the hous until force is applied to the sleeve to release retainer means from the housing.

4. A tool for applying tension to a tubing string defined in claim 1, wherein the means for prevent movement of the sleeve comprises:

a. slip means supported by the housing within longitudinal bore; and b. a rough surface formed on the exterior of sleeve for engagement with the slip means.

5. A tool for applying tension to a tubing string defined in claim 1, wherein the piston means compri:

a. an enlarged diameter portion, formed on the e rior of the sleeve, having two shoulders;

b. a piston ring having a shoulder formed on its ins diameter for engagement with one of the should of the enlarged portion of the sleeve;

c. seal means carried on the inside diameter of piston ring to prevent fluid flow between the e rior of the sleeve and the inside diameter of piston ring;

d. a recess formed on the exterior of the piston ri e. piston seals disposed within the recess to forn fluid tight barrier between the exterior of the pis ring and the inside diameter of the housing;

f. a piston cap engageable with the piston ring; ar g. the piston cap having one shoulder formed on inside diameter to engage the other shoulder of enlarged portion of the sleeve and a second sho der formed on its outside diameter to secure piston seals within the recess.

6. Apparatus for applying tension to a tubing stri which comprises:

a. a housing having a longitudinal bore with openi at either end of the housing;

b. one end of the housing being adapted for conn tion to a tubing string;

c. a sleeve slidably disposed within the longitudi bore and extending through the opening at other end of the housing;

d. the portion of the sleeve extending from the otl end of the housing being adapted for connection a tubing string;

e. the sleeve having a longitudinal passageway communicate fluid from the tubing above the ho ing with the tubing below the housing;

f. an annulus formed between the sleeve and the ho ing within the longitudinal bore;

g. means for sealing within the annulus between sleeve and housing to form a fluid chamber;

h. a piston means carried on the exterior of the slee within the fluid chamber;

i. the piston means dividing the fluid chamber i two variable volume zones;

j. a first port through the housing allowing commu cation of fluid from the exterior of the housing one variable volume zone;

k. a second port through the sleeve allowing comn nication of fluid from the longitudinal passagew to the other variable volume zone;

l. means for allowing movement of the sleeve in c direction relative to the housing when fluid pr sure within the sleeve is higher than fluid press surrounding the housing and preventing movement of the sleeve in the other direction;

a longitudinal keyway formed on the exterior of the sleeve;

key means carried by the housing within the annulus; and the key means positioned within the keyway to prevent rotation of the sleeve with respect to the housing.

Apparatus for applying tension to a tubing string as ıed in claim 6, further comprising:

a retainer means disposed within the annulus;

means for releasably securing the retainer means to the housing; and a shoulder formed on the exterior of the sleeve adjacent the retainer means whereby the sleeve is held in its extended position relative to the housing until force is applied to the sleeve to release the retainer means from the housing.

Apparatus for applying tension to a tubing string as ıed in claim 6, wherein the means for preventing ement of the sleeve comprises:

slip means supported by the housing within the annulus; and a fine threaded surface formed on the exterior of the sleeve for engagement with the slip means.

Apparatus for applying tension to a tubing string as ıed in claim 6, wherein the piston means comprises:

an enlarged diameter portion, formed on the exterior of the sleeve, having two shoulders;

a piston ring having a shoulder formed on its inside diameter for engagement with one of the shoulders of the enlarged portion of the sleeve;

seal means carried on the inside diameter of the piston ring to prevent fluid flow between the outer surface of the sleeve and the inside diameter of the piston ring;

a recess formed on the outside diameter of the piston ring;

piston seals disposed within the recess to form a fluid tight barrier between the exterior of the piston ring and the inside diameter of the housing;

a piston cap engageable with the piston ring; and the piston cap having one shoulder formed in its inside diameter to engage the other shoulder of the enlarged portion of the sleeve and a second shoulder formed on its outside diameter to secure the piston seals within the recess.

. A method of applying tension to a tubing string in a well having a casing string, which comprises:

installing a packer intermediate the ends of the casing string, the packer being adapted to engage the tubing string;

installing a hydraulic tubing tensioner as part of the tubing string while lowering the tubing string into the casing string bore;

lowering the tubing string through the bore of the casing string until the lower end of the tubing string engages the packer;

securing the tubing string to the casing string at the well surface to at least partially support the weight of the tubing string at the surface;

installing a wellhead at the surface to control the communication of fluid with the tubing string;

increasing the pressure of fluid within the tubing string to cause the hydraulic tubing tensioner to contract placing the tubing string in tension between the well surface and the packer.

11. A method for applying tension to a tubing string between two packers within a well having a casing string, which comprises:

a. preparing the lower packer for attachment to the tubing string;

b. installing a hydraulic tubing tensioner as part of the tubing string extending below the upper packer;

c. engaging the tubing string with the lower packer;

d. securing the upper packer within the casing string; and e. increasing the fluid pressure within the tubing string to cause the hydraulic tubing tensioner to contract placing the tubing string between the two packers in tension.

12. The method of applying tension to a tubing string as defined in claim 11, wherein securing the upper packer within casing further comprises:

a. securing the tubing string extending upward from the upper packer to the casing string at the well surface; and b. engaging the upper packer to the inside diameter of the casing string by contracting the hydraulic tubing tensioner causing slips carried by the upper packer to expand and engage the casing string.

13. A hydraulic tubing tensioner for applying tension to a tubing string disposed within a casing string, comprising:

a. a housing having a longitudinal bore extending therethrough;

b. a sleeve slidably disposed within the longitudinal bore and having one end extending from the bore;

c. means for connecting the one end of the sleeve and the opposite end of the housing within a tubing string;

d. the sleeve having a longitudinal passageway therethrough;

e. an annulus formed between the outside diameter of the sleeve and the inside diameter of the longitudinal bore;

f. fixed seals carried on the inside diameter of the housing forming a piston chamber within the longitudinal bore;

g. a piston means, carried on the outside diameter of the sleeve within the piston chamber, dividing the piston chamber into two variable volume zones;

h. the housing having a first lateral port communicating one variable volume zone with the exterior of the housing;

i. the sleeve having a second lateral port communicating fluid pressure within the longitudinal passageway with the other volume zone;

j. slips carried by the housing within the longitudinal bore allowing movement of the sleeve in one direction and preventing movement of the sleeve in the other direction; and k. a keyway formed on the exterior of the sleeve and a key carried by the housing within the longitudinal bore to engage the keyway preventing rotation of the sleeve relative to the housing.

14. A hydraulic tubing tensioner as defined in claim 13, further comprising:

a. a retainer means disposed within the longitudinal bore between the sleeve and the housing;

b. a shear pin releasably securing the retainer means to the housing; and c. a shoulder formed on the exterior of the sleeve adjacent the retainer means whereby the sleeve is held in an extended position relative to the housing until force is applied to the sleeve to shear the pin and release the retainer means from the housing.

15. A hydraulic tubing tensioner as defined in claim 13, wherein the piston means comprises:

a. an enlarged diameter portion, formed on the exterior of the sleeve, having two shoulders;

b. a piston ring having a shoulder formed on its inside diameter for engagement with one shoulder of the enlarged portion of the sleeve;

c. seal means carried on the inside diameter of the piston ring to prevent fluid flow between the exterior of the sleeve and the inside diameter of t piston ring;

d. a recess formed on the exterior of the piston rin e. piston seals disposed within the recess to form fluid tight barrier between the exterior of the pist ring and the inside diameter of the housing;

f. a piston cap engageable with the piston ring; an g. the piston cap having one shoulder formed on inside diameter to engage the other shoulder of t enlarged portion of the sleeve and a second shou der formed on its outside diameter to secure t piston seals within the recess.

* * * * *